United States Patent [19]

Fields

[11] 3,956,962

[45] May 18, 1976

[54] GUITAR AND ADJUSTABLE MUTE THEREFOR

[75] Inventor: Grover G. Fields, Stanton, Calif.

[73] Assignee: CBS Inc., New York, N.Y.

[22] Filed: June 20, 1975

[21] Appl. No.: 588,599

[52] U.S. Cl. ..... 84/267; 84/294

[51] Int. Cl.[2] ..... G10D 1/08

[58] Field of Search ..... 84/310, 307, 313, 267, 84/294, 290, 311

[56] References Cited

UNITED STATES PATENTS

| | | | |
|---|---|---|---|
| 3,134,288 | 5/1964 | Webster | 84/311 |
| 3,260,148 | 7/1966 | Fender | 84/267 |
| 3,406,603 | 10/1968 | Melita | 84/290 |
| 3,427,916 | 2/1969 | Fender | 84/267 |
| 3,538,233 | 11/1970 | Compton et al. | 84/307 X |

*Primary Examiner*—John F. Gonzales

*Attorney, Agent, or Firm*—Gausewitz, Carr & Rothenberg

[57] ABSTRACT

A bass guitar incorporates a number of damping pads which are individually mounted and individually adjustable without tools. Rotational motion of the adjustment is isolated from the pad and its carrier by rotatably mounting the latter to an adjustable shaft, restraining rotation of the shaft and minimizing resistance to relative rotation of the pad carrier and adjustable shaft.

13 Claims, 4 Drawing Figures

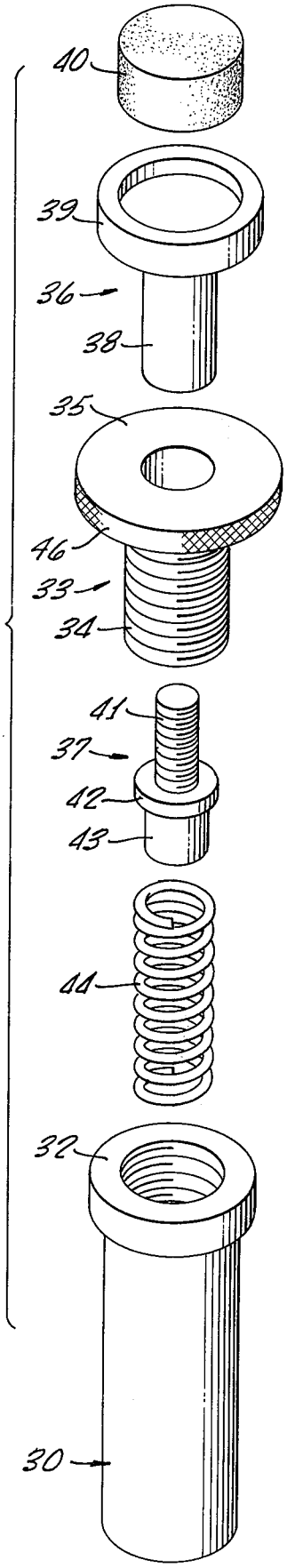
FIG. 3.
FIG. 4.
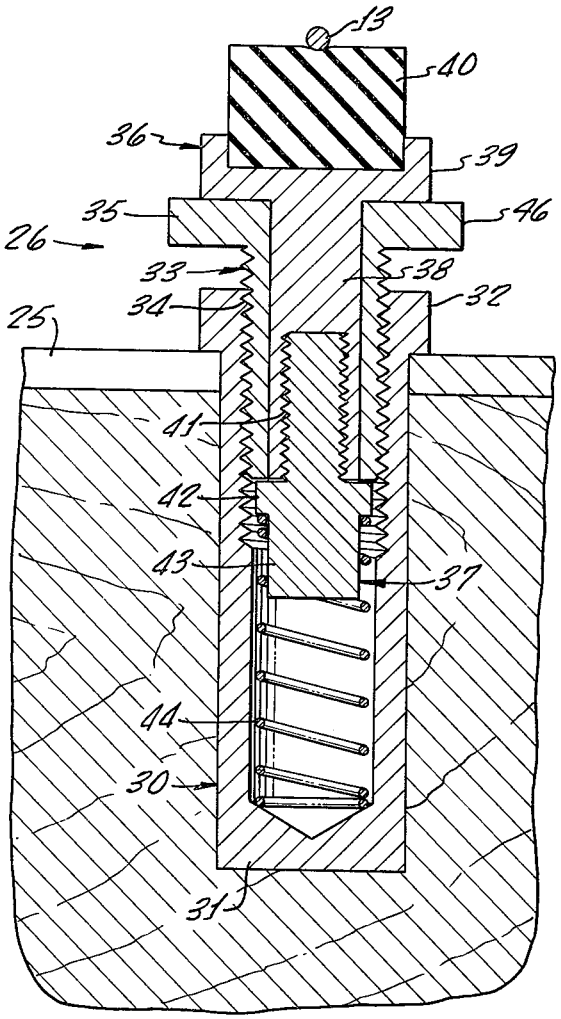

GUITAR AND ADJUSTABLE MUTE THEREFOR

BACKGROUND OF THE INVENTION

The present invention relates to a guitar and more specifically concerns adjustable mutes for damping vibrations of guitar strings. The invention is particularly adapted to be employed in conjunction with a bass guitar although it may also be employed in conjunction with a conventional Spanish guitar, steel guitar and other guitars. A patent of C. L. Fender, for Guitar and Adjustable Mute Therefor, U.S. Pat. No. 3,427,916, assigned to the assignee of the present application, discloses an adjustable mute having a number of spring fingers so arranged that the mutes for individual strings may be separately adjusted by use of a screwdriver and, in addition, all mutes may be collectively adjusted in unison. In the arrangement of the Fender U.S. Pat. No. 3,427,916, each mute pad is carried upon a spring finger that is adjustably carried by a mounting element and adjusted by a mounting screw. Adjustability of the Fender mute is inconvenient due to the fact that a tool must be used to make the adjustment. This makes it difficult to adjust the mute effect during a performance. Further, the several spring fingers occupy a relatively large area of the guitar body and may be accidentally bent to disturb the desired adjustment.

Accordingly, it is an object of the present invention to provide a guitar with individually adjustable mutes requiring no tools for adjustment.

SUMMARY OF THE INVENTION

In carrying out principles of the present invention in accordance with a preferred embodiment thereof, a plurality of individual mutes for the strings of a guitar each comprises a mounting sleeve fixed to the guitar body beneath a string, a shaft carried within the sleeve for rotatable adjustment along the sleeve axis, a carrier assembly mounted to the shaft for rotation about the shaft axis, and a damping pad mounted on the carrier assembly. According to a feature of the invention, a spring mounted within the sleeve, between the sleeve and the carrier assembly, exerts a force against the rotatably adjustable shaft tending to lock the shaft against rotation and thus maintain a selective position of adjustment. The very same spring presses the carrier assembly in a direction such as to significantly decrease frictional resistance to turning exerted between the carrier assembly and the adjustable shaft, so that adjustment of the shaft will not cause the pad to turn and wear against the surface of the damped spring.

BRIEF DESCRIPTION OF THE DRAWINGS

FIG. 3 is an exploded perspective view of elements of an individual mute;

FIG. 4 is a longitudinal sectional view of a mute and part of the guitar body, taken on lines 4—4 of FIG. 2.

DETAILED DESCRIPTION

Figure 1:
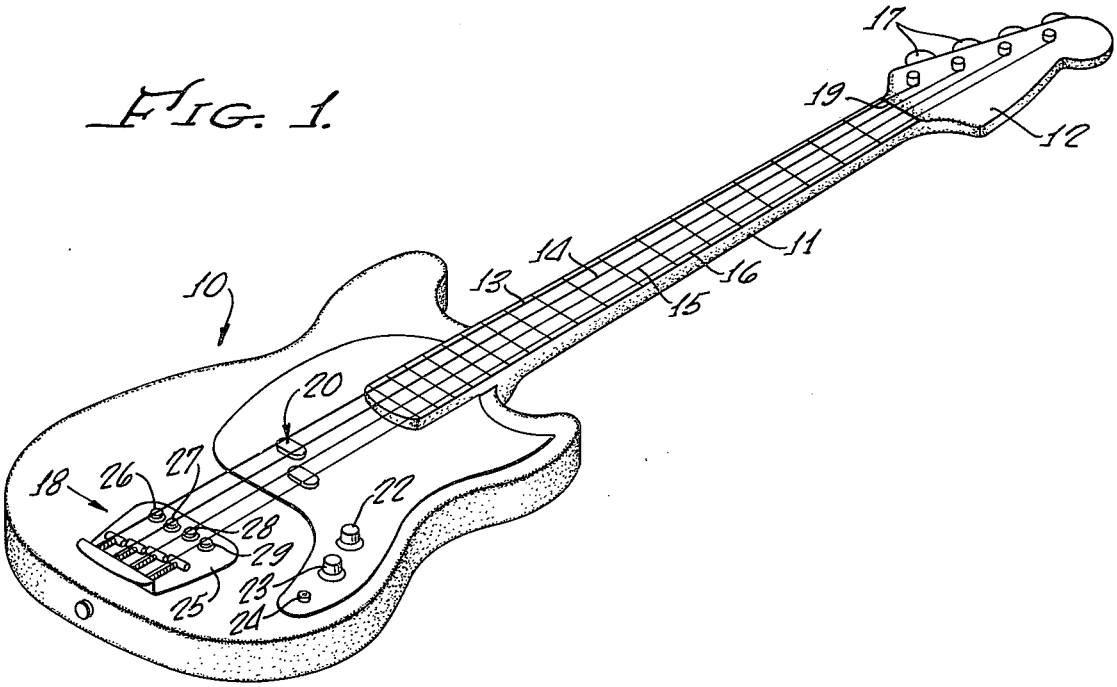
FIG. 1 is a perspective view of a bass guitar incorporating mutes of the present invention.
Figure 2:
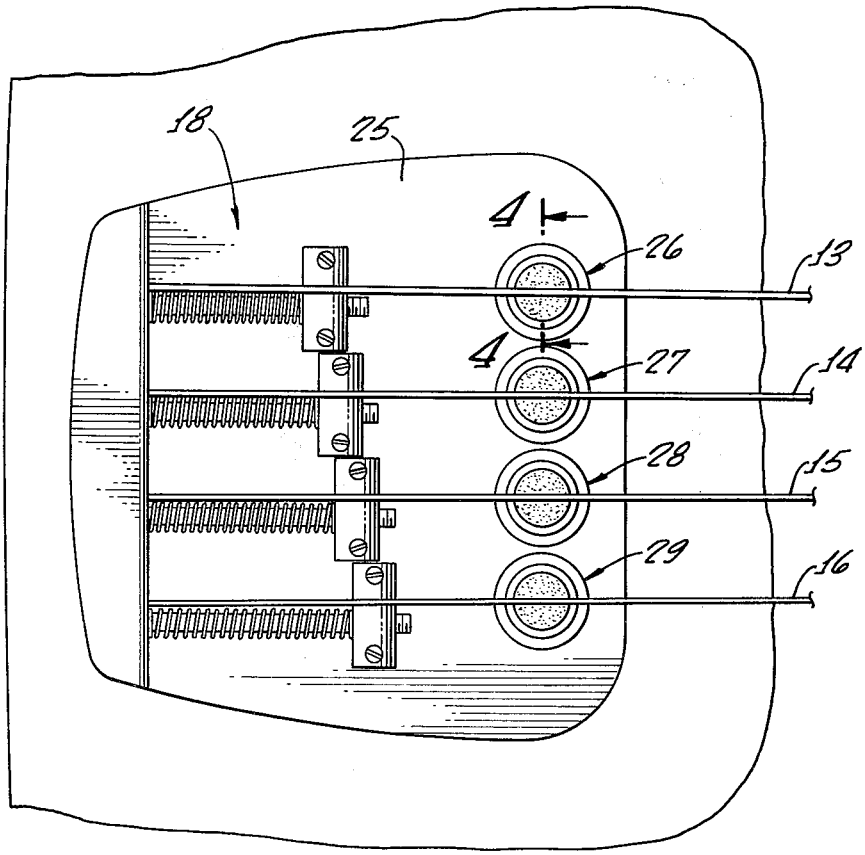
FIG. 2 is an enlarged plan view of the bridge and mute regions of the guitar of FIG. 1.

Referring first to FIG. 1, a bass guitar is illustrated as comprising a body 10, neck 11, head 12 and strings 13 through 16, inclusive. The strings lie generally in a single plane which is spaced above and generally parallel to the plane of the face of body 10. Not only are the strings spaced above the body, but they are spaced from each other, extending in a tensioned relationship from tuning screws 17 to a bridge structure 18. The strings extend over a nut (bridge) 19 adjacent head 12, and also over a suitable pickup (transducer means) 20.

The pickup 20 is electrically connected to control means 22 and 23 adapted to control the volume and tone of the electrical signal generated in response to vibration of one or more of the strings. A jack, indicated at 24, is adapted to receive a plug end of a cord which leads to a suitable amplifier and loud-speaker combination (not shown).

Fixedly mounted to and within the guitar body, each under a respective one of the strings 13 through 16, respectively, is a plurality of mute structures 26, 27, 28 and 29. Each of the mute structures is identical to all of the others and specific details of a typical mute are shown in FIGS. 3 and 4.

Each mute structure comprises a rigid mounting sleeve 30 closed at its inner end 31 and having an outer (upper in FIG. 4) end formed with an enlarged peripheral flange 32. The sleeve is fixedly mounted within mating apertures formed in a bridge plate 25 and in the guitar body 10, being a press fit therein and positioned longitudinally thereof by abutment of the inner surface of flange 32 with the outermost surface of the bridge plate 25.

Sleeve 30 is hollow being closed at its inner end, open at its outer end internally threaded for a portion of its outer length. Threadedly received in the outer portion of sleeve 31 is a rotatably adjustable shaft 33 having a threaded body section 34 and an outer enlarged peripheral flange 35. Threaded body section 34 is received within the sleeve 30, in threaded engagement therein as shown in FIG. 4 The peripheral surface of flange 35 is knurled or otherwise roughened, as indicated at 46, to facilitate turning of this shaft by a musician's fingers.

Mounted to the adjustable shaft 33, for rotation relative thereto about the axis of the shaft and sleeve, is a carrier assembly comprising a rotatable carrier 36 and a carrier retainer 37. Carrier 36 includes a substantially cylindrical body portion 38 which is a snug, but freely rotatable fit within a bore extending entirely through the adjustable shaft 33. Formed on the outer end of the carrier 36 is an enlarged head 39 having an upstanding rim that defies a cup-shaped recess in which is fixedly seated a soft resilient pad or a damping element 40. The pad is conveniently formed of a soft sponge rubber or the like and is fixed within the cup of the carrier head 39 by a suitable adhesive.

Although the carrier 36 may be retained against axial withdrawal within the bore of adjustable shaft 33 by a number of different arrangements, it is found convenient to employ the carrier retainer 37 illustrated in FIGS. 3 and 4. Such a retainer not only prevents withdrawal of the carrier from the adjustable shaft but performs additional functions as will be described below.

Retainer 37 includes an externally threaded section of 41 which is engaged with an internally threaded section at the inner end of body section 38 of carrier 36. The retainer also includes, at an intermediate portion thereof, an enlarged peripheral flange 42 having a diameter greater than the diameter of body section 38 and greater than the diameter of the bore formed in adjustable shaft 33.

The innermost of end of retainer 37 comprises a relatively enlarged cylindrical section of 43 which receives the outermost end of a compression spring 44 seated at its inner end upon the closed inner end of sleeve 31. The outer end of spring 44 extends about the retainer section 43 and presses outwardly against the inner side of carrier retainer flange 42. The spring then presses the several elements including the carrier assembly and the adjustable shaft outwardly of the guitar body, or upwardly as viewed in FIG. 4. Pressing against the flange 42 of the carrier retainer 37, the spring causes the latter to bear against the innermost end of adjustable shaft section 34. This pushes the adjustable shaft upwardly, tending to lock the shaft against relative rotation with respect to the sleeve or at least to increase the resistance of the threaded engagement to such relative rotation. Spring 44 is so dimensioned that when the mute is in an intermediate position of adjustment the spring is compressed to a substantial extent so as to insure its latching or locking action against the rotational adjustment of shaft 33.

Just prior to assembly of carrier retainer 37 to the carrier 36, the threaded section 41 of the retainer has an adhesive applied thereto so that the carrier and retainer are fixedly locked to each other after the adhesive has set. This combination of carrier and retainer is freely rotatable relative to adjustable shaft 33 about the axis of the shaft and sleeve 30. Resistance to relative rotation of the carrier assembly and adjustable shaft is significantly decreased by action of the same spring 44 simultaneously effects latching of the rotational adjustment of the shaft with respect to the sleeve.

This section action of the spring, the action by which it decreases frictional resistance to rotation of the carrier assembly is due, in part, to the relative sizes of the carrier head 39 and the retainer flange 42. The carrier head 39 is considerably larger than carrier retainer flange 42, and more significantly, the flange 42 has a considerably smaller area of contact with the innermost end of adjustable shaft 33, as compared with the area of contact between the inner surface of head 39 and the outer surface of adjustable shaft flange 35. Therefore, as the spring 44 presses the retainer and the assembly of retainer and carrier outwardly (upwardly as viewed in FIG. 4) frictional force between the inner surface of carrier head 39 and the outwardly facing surface of shaft flange 35 is relatively decreased and the pressure of the carrier retainer flange 42 upon the inner shaft end is relatively increased. The area of the latter pressure is considerably smaller and therefor the frictional resistance to rotation is decreased by action of the spring.

It is significant that such resistance to rotation is decreased and that the carrier assembly be rotatable relative to the shaft with very little force applied thereto. This will minimize wear of the mute pad 40 by rotational rubbing against a string, such as string 13, which is pressed thereon. Thus, rotation of the adjustable shaft 33 to change the magnitude of the muting effect will not cause rotation of the carrier assembly or mute pad 40 and, thus, will not cause the string 13 to wear the surface of the mute pad.

Operation of the illustrated mute is readily apparent from inspection of the drawings. Flange 35 is grasped between the musician's fingers and the shaft is rotated in one direction or the other, thereby raising or lowering the shaft together with the carrier assembly mounted thereto. As the carrier assembly moves up or down, mute pad 40 moves with it, thus providing increased or decreased damping. It is again emphasized that as the shaft 33 is rotated to effect its axial adjustment, the carrier assembly, which is freely rotatable therein and which has its frictional resistance to rotation significantly decreased as previously described, only a light engagement of the string upon the pad 40 is needed to prevent rotation of the pad in the course of the shaft adjustment.

Many musicians find that it is neither necessary nor desirable to accomplish adjustment of all of the mute pads simultaneously. The ready and rapid manual adjustment (without tools) of the described mute pads is an adequate alternative to prior art simultaneous adjustment.

There has been described a guitar with a unique mute structure wherein a simple rapid and easily accessible adjustment without tools is obtained in a simple, reliable, compact and esthetic structure. Rotational adjustment is readily accomplished without rotating the mute pad and, therefore, with a minimum of wear upon the pad. Preferably all of the parts, except for the pad, are made of metal such as steel or aluminum, although it will be readily appreciated that other materials such as plastic may be readily employed where deemed necessary or desirable.

Vertical adjustability of the mute structure described is available and desirable not only for variation of the muting effect upon the strings, but also to accommodate the vertical adjustability of the bridge structure, where such vertical adjustability is provided.

The foregoing detailed description is to be clearly understood as given by way of illustration and example only, the spirit and scope of this invention being limited solely by the appended claims.

It is claimed:

1. In combination with a guitar having a plurality of spaced and general parallel strings mounted in tensioned relationship over a body, said strings lying generally in a plane substantially parallel to the face of said body, a plurality of individual mutes for said strings, each said mute comprising:

a mounting sleeve fixedly secured to said body beneath an individual one of the strings, a shaft carried within said sleeve for rotatable adjustment along the axis of said sleeve, a carrier assembly mounted to said shaft for rotaion about the axis of the shaft, and a damping pad mounted on the carrier assembly.

2. The combination of claim 1 where said shaft is threadedly engaged within said mounting sleeve for adjustment relative to said sleeve, and wherein said shaft includes a radially outwardly projecting flange adapted to be grasped by a musician's fingers for rotational adjustment of said shaft, whereby said damping pad may be adjusted by rotation of said shaft and without rotation of the carrier assembly and damping pad relative to the associated string.

3. The combination of claim 2 including means for resisting rotation of said shaft relative to said mounting sleeve.

4. The combination of claim 3 including means for decreasing frictional engagement between said carrier assembly and said adjustable shaft.

5. The combination of claim 2 including spring means for urging both said carrier assembly and said adjustable shaft axially of said mounting sleeve.

6. The combination of claim 5 wherein said carrier assembly comprises a cylindrical carrier body having a circumferentially extending flange at one end thereof forming an enlarged carrier head, said damping pad being secured to said carrier head, said adjustable shaft having a bore extending therethrough, said carrier body extending through said shaft bore, and including means for retaining said carrier body within said shaft bore.

7. The combination of claim 6 wherein said last named means comprises an internally threaded bore formed in the other end of said carrier body and a carrier retainer threadedly engaged within said last named bore, said retainer having a second flange of a diameter greater than the diameter of said carrier body, and second flange rotatably bearing upon an end of said adjustable shaft.

8. The combination of claim 6 wherein said last named means comprises a carrier retainer fixed to the other end of said carrier body and having a second flange of a diameter greater than the diameter of said carrier body, said second flange rotatably bearing upon the end of said adjustable shaft.

9. The combination of claim 8 including resiliently compressible means interposed between an end of said mounting sleeve and said second flange.

10. A mute of damper device for a bass guitar or similar string instrument, said device comprising:

a mounting sleeve, an adjustable shaft threadedly engaged within said sleeve, a rotatable carrier assembly mounted to said shaft for rotation about the axis thereof, and a damping pad carried by said assembly.

11. The device of claim 10 including means for restraining relative rotation of said shaft and sleeve and concomitantly decreasing resistance to relative rotation of said carrier and shaft.

12. The device of claim 11 wherein said last named means comprises spring means for urging said shaft axially of said sleeve.

13. The device of claim 10 wherein said adjustable shaft is formed with a bore extending axially therethrough and an enlarged circumferentially extending flange adapted to be grasped by an operator for rotation of the shaft relative to the sleeve, said carrier assembly comprising a cylindrical carrier body rotatably mounted within said shaft bore and having an outwardly extending circumferential flange formed on one end thereof, said damping pad being mounted upon said carrier flange, said carrier body having a second outwardly extending circumferential flange on the other end thereof, said second flange having a diameter less than the diameter of said first named carrier flange, and a spring interposed between an end of said sleeve and said second flange.

* * * * *

UNITED STATES PATENT OFFICE

CERTIFICATE OF CORRECTION

PATENT NO. : 3, 956, 962

DATED : May 18, 1976

INVENTOR(S) : Grover G. Fields

It is certified that error appears in the above-identified patent and that said Letters Patent are hereby corrected as shown below:

Column 1, line 59, after "mute;" insert --- and ---.

Column 4, line 44 (line 11 of claim 1), change "rotaion" to --- rotation ---.

Column 5, line 12 (line 7 of claim 7), change "and" to --- said ---; column 5, line 23 (line 1 of claim 10), change "of" to --- or ---.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*